US006151985A

United States Patent [19]

Garber et al.

[11] Patent Number: 6,151,985

[45] Date of Patent: Nov. 28, 2000

[54] ADJUSTABLE PEDAL APPARATUS

[75] Inventors: David L. Garber; John Schambre, both of Canton; Dwight S. Brooks, New Boston; Liliana Neag, Walled Lake; Michael O. Forker, Novi; L. Guy Montford, Canton; Jack Soullier, Troy; Howard A. Estes, Jr., Ann Arbor, all of Mich.

[73] Assignee: DaimlerChrysler Corporation, Auburn Hills, Mich.

[21] Appl. No.: 09/283,458

[22] Filed: Apr. 1, 1999

[51] Int. Cl.[7] ..... G05G 1/14

[52] U.S. Cl. ..... 74/512; 74/522; 74/560; 180/334

[58] Field of Search ..... 74/512, 513, 560, 74/561, 522; 180/315, 334

[56] References Cited

U.S. PATENT DOCUMENTS

| | | | |
|---|---|---|---|
| 3,319,487 | 5/1967 | Lystad et al. | 180/334 |
| 3,643,524 | 2/1972 | Herring | 74/512 |
| 3,643,525 | 2/1972 | Gibas | 74/512 |
| 3,691,868 | 9/1972 | Smith | 74/512 |
| 3,741,033 | 6/1973 | Wilke et al. | 74/512 |
| 4,870,871 | 10/1989 | Ivan | 74/513 |
| 4,875,385 | 10/1989 | Sitrin | 74/513 |
| 4,989,474 | 2/1991 | Cicotte et al. | 74/512 |
| 5,010,782 | 4/1991 | Asano et al. | 74/512 |
| 5,078,024 | 1/1992 | Cicotte et al. | 74/512 |
| 5,086,663 | 2/1992 | Asano et al. | 74/512 |
| 5,351,573 | 10/1994 | Cicotte | 74/512 |
| 5,460,061 | 10/1995 | Redding et al. | 74/512 |
| 5,632,183 | 5/1997 | Rixon et al. | 74/512 |
| 5,676,220 | 10/1997 | Dapsi et al. | 180/334 |
| 5,697,260 | 12/1997 | Rixon et al. | 74/514 |
| 5,722,302 | 3/1998 | Rixon et al. | 74/512 |
| 5,771,752 | 6/1998 | Cicotte | 74/512 |
| 5,996,438 | 12/1999 | Elton | 74/512 |

FOREIGN PATENT DOCUMENTS

| | | | |
|---|---|---|---|
| 2-39214 | 2/1990 | Japan | 74/512 |
| 2-39215 | 2/1990 | Japan | 74/512 |
| 2-39217 | 2/1990 | Japan | 74/512 |
| 93/07551 | 4/1993 | WIPO | 74/560 |

OTHER PUBLICATIONS

*Automotive News,* Feb. 15, 1999, "Move the pedal, not the seat . . . Teleflex Automotive Group, Warren, Mich.", Crain Communications, Inc.

*Primary Examiner*—David A. Bucci
*Assistant Examiner*—Chong H. Kim
*Attorney, Agent, or Firm*—Marc Lorelli

[57] ABSTRACT

An adjustable pedal apparatus for a motor vehicle is provided. The apparatus includes a pedal that can be translated in a longitudinal fashion parallel to the vehicle floor. The apparatus includes a pedal pivotally attached to a pivot pin. The pivot pin is threadedly attached to a powered screw to allow translation thereon in response to rotation of the screw. The pivot pin is received in a second longitudinal slot formed in a base formation. An attachment link is pivotally attached to the pivot pin and includes an elongated opening for receiving a driving pin and a pushrod attachment. Driving pin and pushrod attachment are free to slide and pivot with their attachment to the attachment link. A power link is also provided. The power link is pivotally attached to the pedal at an elevation lower than the pivot pin. The power link also includes an elongated opening. The power link opening is adapted to receive the driving pin as well as a stationary pin disposed at an elevation comparable with the pivot pin of the pedal. Both the driving pin and the stationary pin are capable of sliding and rotating within the elongated opening of the power link. As the pedal is depressed the power link forces the driving link rearward, and the driving pin in connection with the attachment link and pivot pin drive the pushrod to activate the desired function of the vehicle. This operation of the pushrod holds true irrespective of the location of the pivot pin on the powered screw.

9 Claims, 6 Drawing Sheets

ADJUSTABLE PEDAL APPARATUS

BACKGROUND OF THE INVENTION

1. Technical Field

The present invention relates in general to motor vehicle pedals. More particularly, but without restriction to the particular embodiment and/or use which is shown and described for purposes of illustration, the present invention relates to pedal systems that provide for adjustment of the brake, clutch, or accelerator pedal relative to a vehicle driver.

2. Discussion

In a conventional automobile, pedals are provided for controlling the acceleration and braking functions of the vehicle. If the vehicle includes a manual transmission, a clutch pedal is typically provided. In most motor vehicles today, the pedals have fixed locations. Typically, these pedals are fixed to the body of the vehicle at a point, so that the pedal will pivot about the fixed point when foot pressure is applied by the operator. In order to accommodate driver's of varying physiques, the driver's seat is generally slidingly engaged to the vehicle such that a driver can position himself or herself relative to either the steering wheel or the pedals. This adjustment provides, to a certain degree, an improvement of driver comfort.

However, it is nearly impossible to such a single adjustment to accommodate all possible variances in human physiques. In particular, the proportional relation between the lengths of a driver's arms and legs in relation to the driver's overall torso size cannot be accommodated through a single adjustment. For example, many smaller people have small legs. Therefore, when they drive a motor vehicle, they must position the seat in its foremost position in order to properly reach the pedals. Unfortunately, their arms and torso are typically too close to the steering wheel of the vehicle to be comfortable. Accordingly, it has been widely recognized that some type of pedal adjustment is desirable to provide optimal comfort to the driver while he or she is operating the vehicle.

Many approaches to providing adjustable pedals have been suggested in the prior art. The most common approach is to provide some type of pushrod, racheting, or camming device so that the pedal will operate in a different pivotal range. By utilizing such a device, the static position of the pedal can be modified in the forward and rearward direction. An example of this approach is provided in U.S. Pat. No. 5,771,752, issued Jun. 30, 1998. Although, in general, this type of system works satisfactorily in providing an adjustable pedal, the distance of the pedal to the floor will change as the pedal is pivoted. This may be not desirable because it changes the angle at which foot pressure needs to be applied, and may affect the angle at which the master cylinder pushrod for a brake pedal is activated.

Many other adjustable pedal systems have been developed in the recent years that provide a linear movement of the pedals so as to maintain the relationship between the pedal and floor. A few examples of such applications can be found in U.S. Pat. No. 4,870,871, issued Oct. 3, 1989, U.S. Pat. No. 5,722,302, issued Mar. 3, 1998, and U.S. Pat. No. 5,010,782, issued Apr. 30, 1991. Although prior art devices such as those described above have proven to be successful, there is a need to develop a system that properly accommodates pedal attachments while the pedal is translated in a longitudinal manner.

Attachments are used to actually activate the desired function of the vehicle, for example, a brake pedal will activate a brake booster via some sort of attachment commonly referred to as a pushrod. The present invention also represents substantial improvements over the pedal design disclosed in the aforementioned patents.

SUMMARY OF THE INVENTION

Accordingly, it is a principal objective of the present invention to provide a truly versatile and effective adjustable pedal apparatus for use in a motor vehicle.

It is another objective of the present invention to provide an adjustable pedal apparatus that accommodates a pedal attachment similar to those commonly used in today's vehicles.

It is still another objective of the present invention to provide an adjustable pedal apparatus that fits into a compact space for packaging effeciencies.

In one form, the present invention provides an adjustable pedal apparatus for a motor vehicle. The present invention includes a pedal pivotally having a pivot pin. The pivot pin is threadedly attached to a powered screw to allow translation thereon in response to rotation of the screw. The pivot pin is received in a second longitudinal slot formed in a base formation. An attachment link is pivotally attached to the pivot pin and includes an elongated opening for receiving a driving pin and a pushrod attachment. Driving pin and pushrod attachment are free to slide and pivot with their attachment to the attachment link. A power link is also provided. The power link is pivotally attached to the pedal at an elevation lower than the pivot pin. The power link also includes an elongated opening. The power link opening is adapted to receive the driving pin as well as a stationary pin disposed at an elevation comparable with the pivot pin of the pedal. Both the driving pin and the stationary pin are capable of sliding and rotating within the elongated opening of the power link. As the pedal is depressed the power link forces the driving link rearward, and the driving pin in connection with the attachment link and pivot pin drive the pushrod to activate the desired function of the vehicle. This operation of the pushrod holds true irrespective of the location of the pivot pin on the powered screw.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1:
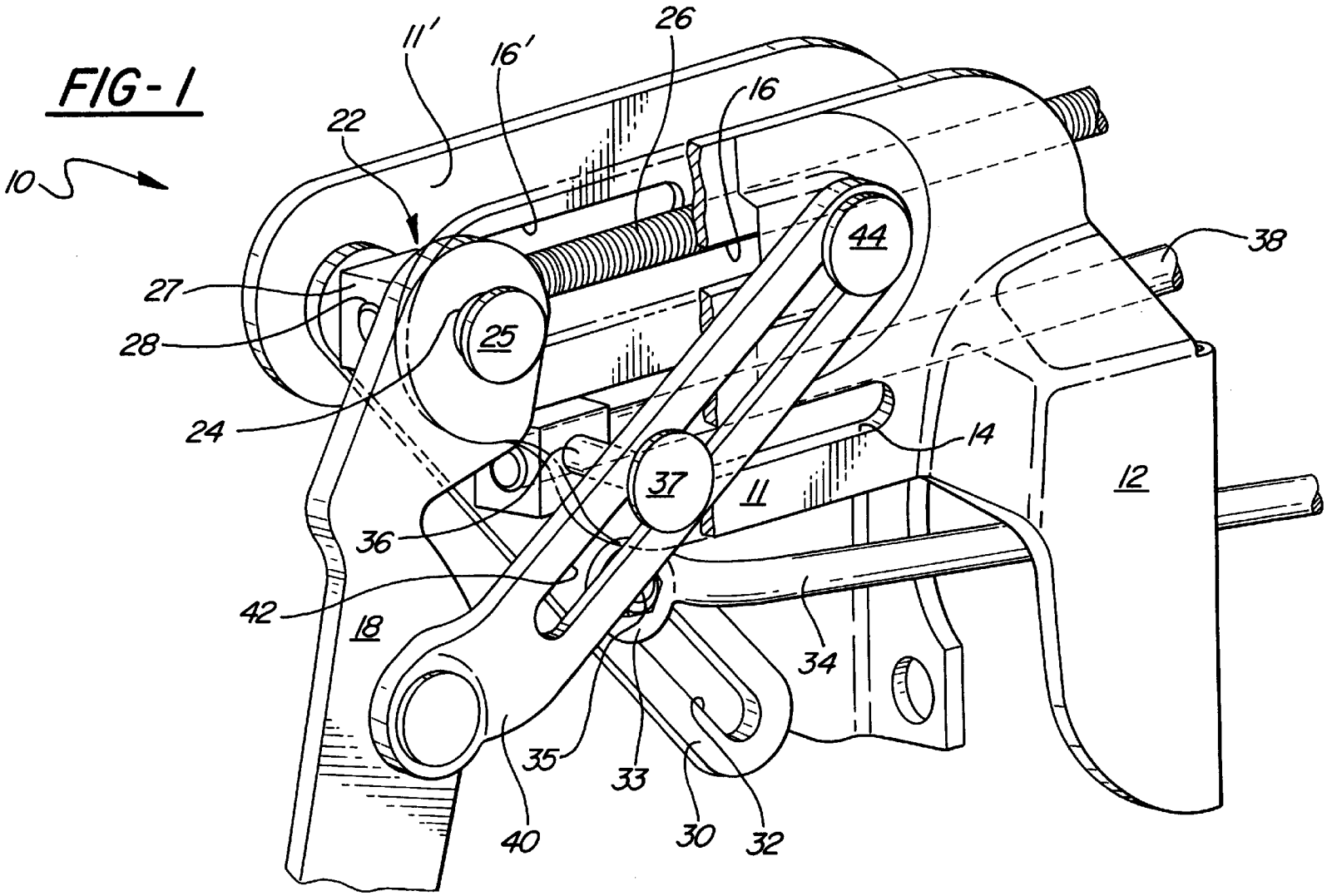
FIG. 1 is a perspective view of the top portion of an adjustable pedal apparatus from the right.
Figure 2:
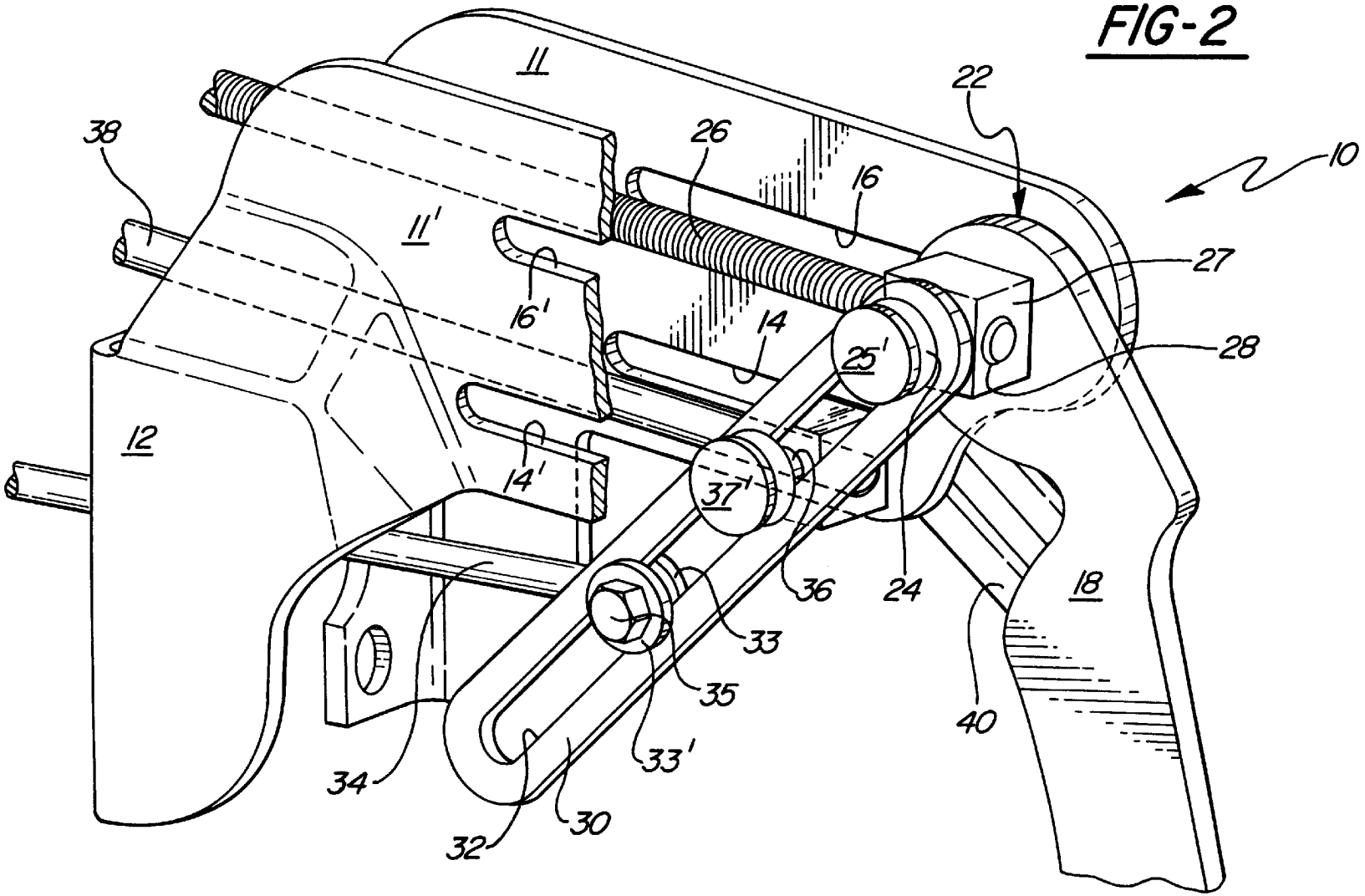
FIG. 2 is a perspective view of the top portion of an adjustable pedal apparatus from the left.

Referring now to the drawings, there is depicted an adjustable pedal apparatus illustrating the preferred embodiment of the present invention. With reference to FIG. 1 and FIG. 2, an adjustable pedal apparatus 10 is shown. The preferred embodiment is illustrated on a brake pedal system, however, the teachings of this invention can be utilized on acceleration and clutch pedals as well as brake pedals and are within the scope of the present invention. Apparatus 10 includes a base formation 12 that is adapted to be attached to the vehicle body or chassis (not shown). Base formation includes two projections extending therefrom in a parallel fashion 11 and 11'. Each projection 11 and 11' includes a first slot 14 and 14' formed therein and a second slot 16 and 16' formed therein and elevated from the first slot 14. The second slot is disposed at an elevation equal to the pivot point of pedal 18. Pedal 18 includes a foot portion 20, best seen in FIG. 3, and a top or pivot end 22. Pedal 18 includes a pivot pin 24 near its top end 22. Pivot pin 24 is adapted to be received by second slots 16 and 16', pivot pin extends outboard of each slot and terminates in a cap portion 25 and 25' in each end to ensure stable reception by slots 16 and 16'. Pivot pin 24 is also threadedly attached to a screw 26 between the cap portions 25 and 25'. Pivot pin 24 includes a central portion 27 with a threaded bore 28 for reception of screw 26, whereby rotation of screw 26 will cause pivot pin 24 to translate thereon. Screw 26, in essence, controls the longitudinal position of pivot pin 24. Screw 26 can be rotated by a motor or even manually, if desired.

Attached to one end of pivot pin 24 is an attachment link 30. Pivot pin 24 is pivotally attached to attachment link 30 near the top end thereof. Link 30 is disposed outboard of projection 11' and includes an elongated opening 32 formed therein. The pushrod 34 that is utilized to activate the brake booster is pivotally and slidingly attached to attachment link 30 within elongated opening 32. Pushrod 34 terminates in a pin 35 with two flanges 33 and 33' that allows pin 35 to freely rotate and slide within elongated opening 32. The attachment between pushrod 34 and attachment link 30 is referred to generally as pushrod attachment 37 for illustrative purposes. The length and height of pushrod 34 defines the angle at which attachment link 30 is disposed about pivot pin 24, in the static pedal position. Attachment link 30 is also slidingly and pivotally attached to a driving pin 36. Driving pin 36 is received by first slots 14 and 14' and includes caps 37 and 37' so as to ensure that pin 36 is only allowed to move in a longitudinal direction as defined by slots 14 and 14'. Preferably, driving pin 36 is slidingly engaged to a driving shaft 38 and adapted to slide longitudinally thereon in order to track the load. It should be appreciated that driving pin 36 and pushrod attachment 37 are slidingly and pivotally engaged to attachment link 30, while pivot pin 24 is only pivotally attached to the attachment link 30.

Pedal 18 also includes a power link 40 pivotally attached thereto at an elevation lower than pivot pin 24. Power link 40 includes an elongated opening 42 formed therein. Driving pin 36 is slidingly and pivotally connected to power link 40 inboard of projection 11. Power link 40 is also slidingly and pivotally attached to a stationary pin 44. Stationary pin 44 is disposed at an elevation comparable to that of the second slot 16, and it should be appreciated that the location of pin 44 is fixed. It should also be appreciated that the driving pin 36 is associated with both the attachment link 30 and the power link 40, it is the driving pin 36 that transfers the load from one link to the other.

Figure 3:
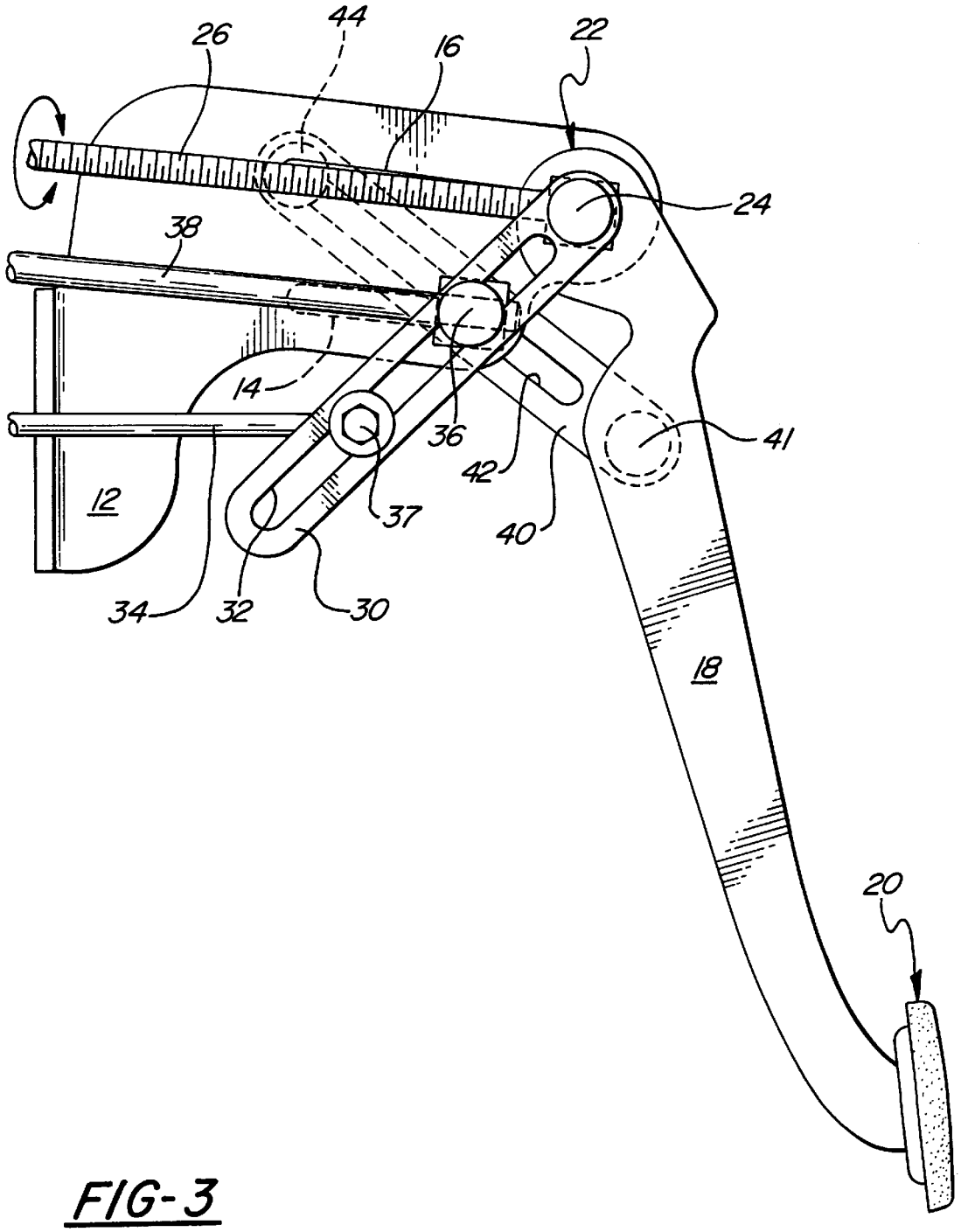
FIG. 3 is a side view of the adjustable pedal apparatus illustrating the pedal in the full forward location and in the static or non-depressed position.
Figure 4:
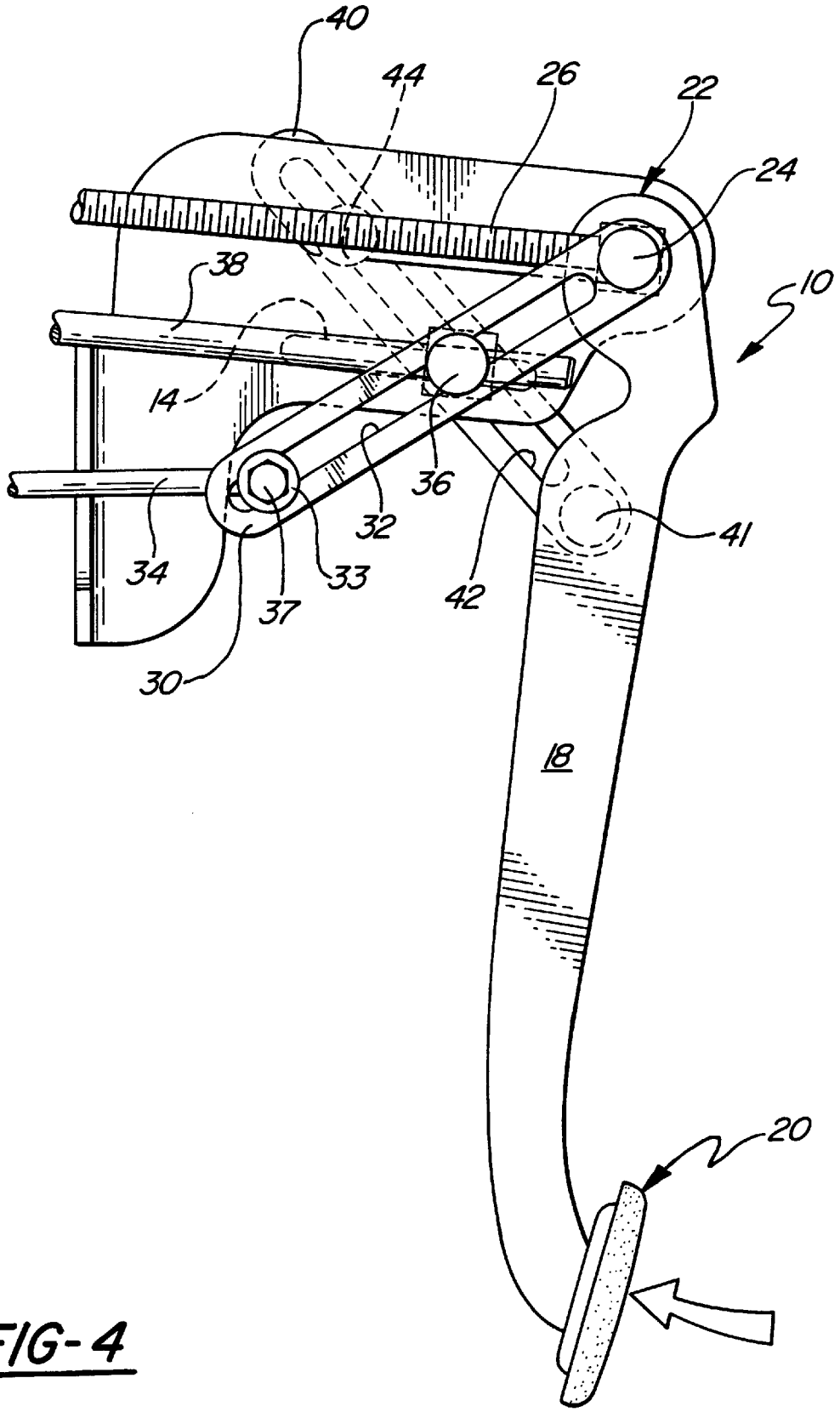
FIG. 4 is a side view of is a side view of the adjustable pedal apparatus illustrating the pedal in the full forward location and in the fully depressed position.

FIG. 3 illustrates adjustable pedal apparatus 10 in the static or non-depressed position and in the full forward location, closest to the driver of the vehicle. FIG. 4 illustrates the adjustable pedal apparatus in the same location with the pedal 18 depressed. With reference to FIG. 3 and FIG. 4, the depression of the pedal will now be described in detail. As pressure is placed on the foot portion 20 of pedal 18, the pedal 18 begins to depress or pivot about pivot pin 24. The power link 40 must move so that that the stationary pin 44, the pivotal attachment to the pedal 18, and the driving pin 36 are all in a linear arrangement. The position of the stationary pin 44 is fixed and the position of the driving link pivotal attachment 41 to pedal 18 is dependent upon the amount of depression of the pedal 18. Therefore, the driving pin 36 must slide longitudinally within first slots 14 and 14' to accommodate such a movement. In essence, the power link 40 forces the driving pin 36 to move longitudinally backwards. Therefore, since power link 40 requires driving pin 36 to move, the orientation of the attachment link 30 is affected. Attachment link 30 now must define a linear relationship between pivot pin 24 of pedal 18, driving pin 36, and the pushrod attachment 34. Since the location of the pivot pin 24 is fixed and the driving pin 36 location is set by the power link 40; the attachment link 30 forces the pushrod 34 to move laterally backwards, and therefore pushrod 32 move laterally backward, thereby activating the braking functions of the vehicle. This occurs in order to maintain a linear alignment between pivot pin 24, driving pin 36, and pushrod attachment 37. This arrangement is illustrated in FIG. 4. As the pedal 18 is released, or un-depressed, the adjustable pedal apparatus 10 transitions in a manner substantially opposite of that previously described for depression. It should be appreciated that the return force is initiated by the pushrod 34 by its desired to return to the unactivated position as dictated by the master cylinder of the braking system.

Figure 5:
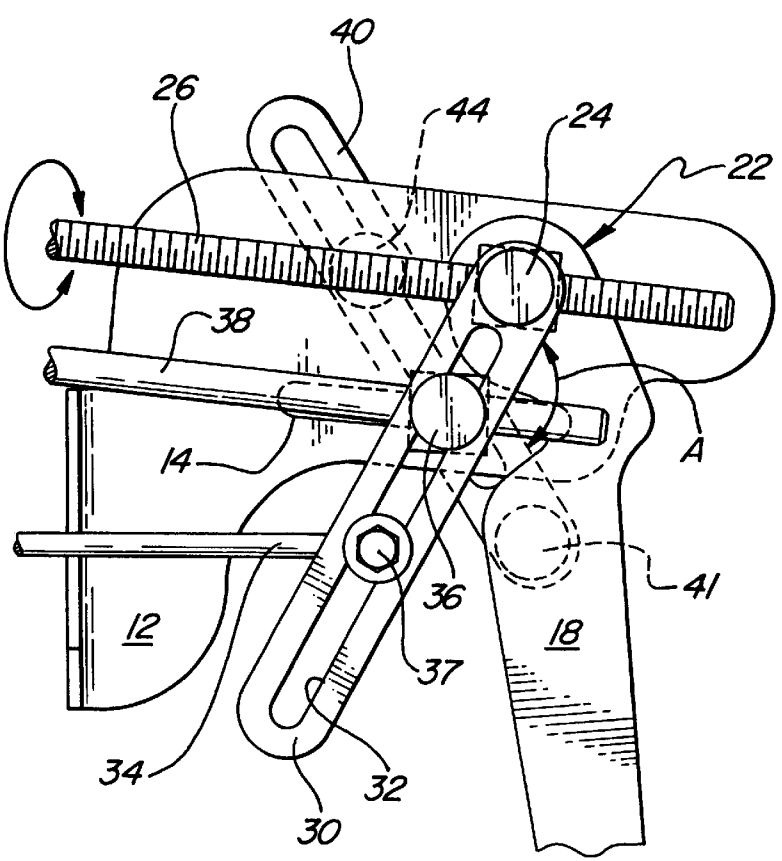
FIG. 5 is a side view of the adjustable pedal apparatus illustrating the pedal in an intermediate location and in the static position.

FIG. 5 illustrates the adjustable pedal apparatus 10 is a middle or intermediate location, between the full forward location and the full rearward location. It should be appreciated that that are numerous intermediate positions possible and that the one shown in FIGS. 5 is for illustrative purposes. Screw 26 is rotated such that pivot pin 24 is translated thereon. As screw 26 is rotated in a first direction, pivot pin 24 along with pedal 18 is translated rearward, or in a direction away from the operator of the vehicle. As the screw 26 is rotated in a second direction, opposite of said first direction, pivot pin 24 along with pedal 18 is translated forward. The translation is attributable to the threaded attachment between screw 26 and pivot pin 24. It should be appreciated that any translational method may me utilized to move pivot pin 24 forward and rearward and any such method is within the scope of the present invention.

As pivot pin 24 is translated rearward, power link 40 causes driving pin 36 to move laterally backward due to the required linear alignment of the stationary pin 44, the driving pin 36, and the pivotal attachment 41 of the power link 40 to the pedal 18. The attachment link 30 must also keep a linear arrangement between the driving pin 36, the pivot pin 24, and the pushrod attachment 34. It should be appreciated that the pushrod attachment 37 will side along the elongated opening 32 of the attachment link 30 to as to not activate the braking functions of the vehicle. This is due to the fact that pivot pin 24 moves longitudinally with the driving pin 36, this aids is maintaining a linear arrangement between the pivot pin 24, driving pin 36, and the pushrod attachment 34. The pushrod attachment 37 is allowed to slide for slight modifications in alignment. Therefore, as pedal 18 is translated rearward attachment link 30 and power link 40 become more in line with each other. To put it more clearly, the angle formed between the links as indicated by A in FIG. 5 gets closer to 180 degrees.

Figure 6:
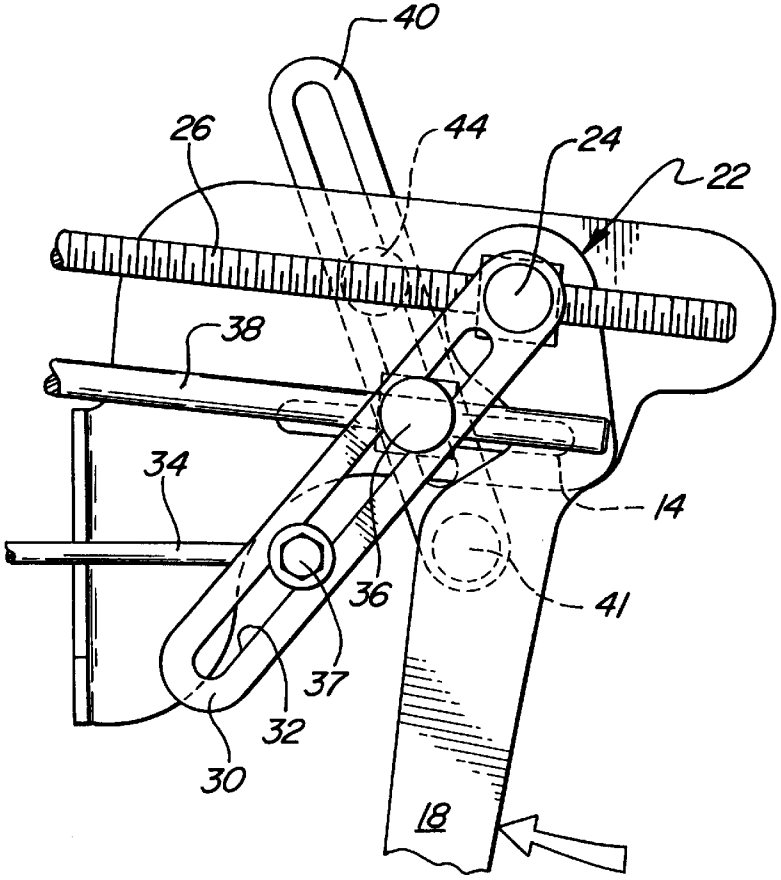
FIG. 6 is a side view of the adjustable pedal apparatus illustrating the pedal in an intermediate location and in the fully depressed position.

FIG. 6 illustrates the depression of pedal 18 while in an intermediate location. This action is similar to the depression of the pedal 18 while in the full forward position, which was previously described. While the pedal 18 is in the intermediate location, the angles of the attachment link 30 and the driving link 40 are different from the full forward location, but the action of the links 30 and 40 that coincides with the depression of the pedal 18 is similar.

Figure 8:
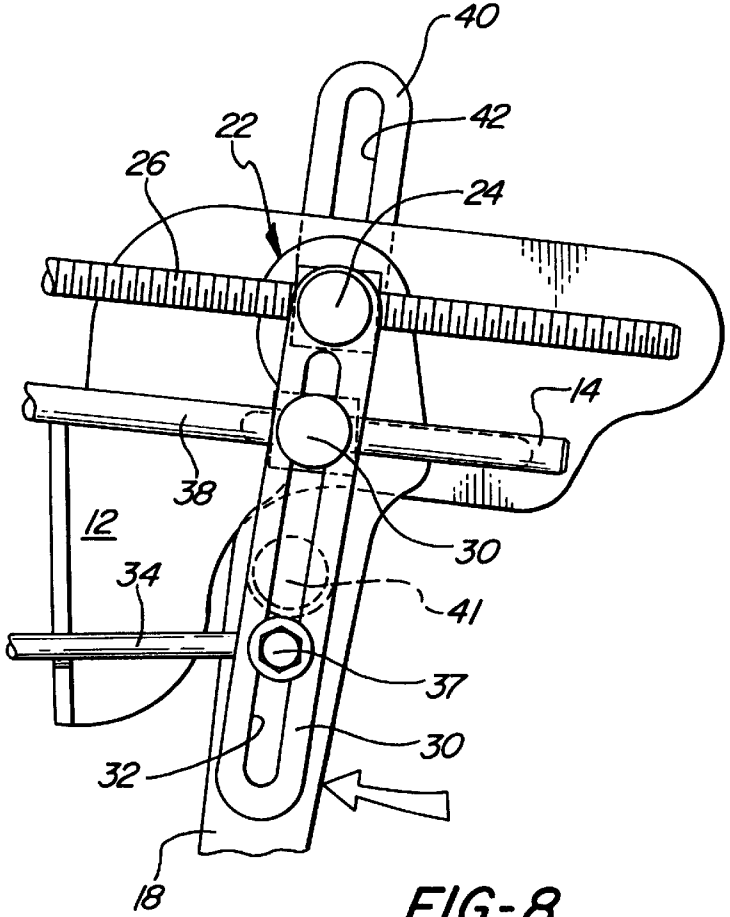
FIG. 8 is a side view of the adjustable pedal apparatus illustrating the pedal in the full rearward location and in the fully depressed position.
Figure 7:
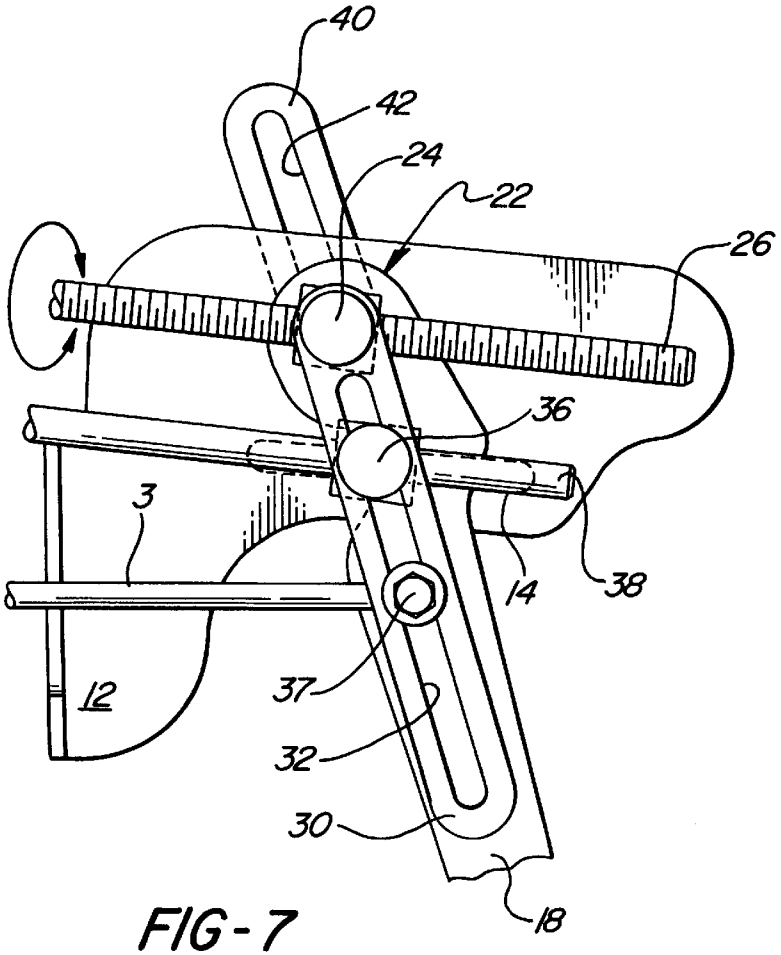
FIG. 7 is a side view of the adjustable pedal apparatus illustrating the pedal in the full rearward location and in the static or position.

FIG. 7 and FIG. 8 illustrate the adjustable pedal apparatus 10 in the full rearward location. It should be appreciated that the full rearward location performs like a conventional pedal apparatus. As pedal 18 is depressed, the pushrod 34 is depressed accordingly.

While the above description constitutes the preferred embodiment of the invention, it will be appreciated that the invention is susceptible to modification, variation, and change without departing from the proper scope or fair meaning of the accompanying claims.

What is claimed is:

1. An adjustable pedal apparatus comprising:

a pedal, wherein said pedal includes a pivot pin and is attached to a translational structure;

an attachment link pivotally attached to said pedal;

a power link pivotally attached to said pedal;

a driving pin slidingly engaged with said power link and said attachment link, and a stationary base formation having a first and second slot, said second slot adapted to receive said pivot pin.

2. The invention as set forth in claim 1, further comprising a stationary pin disposed at an elevation comparable to the elevation of said pivot pin.

3. The invention as set forth in claim 2, wherein said first slot is adapted to receive said driving pin.

4. The invention as set forth in claim 3, wherein said power link is slidingly and pivotally attached to said driving pin and said stationary pin.

5. The invention as set forth in claim 4, further comprising a pushrod for activation of a desired vehicle function, said pushrod slidingly and pivotally attached to said attachment link.

6. The invention as set forth in claim 5, wherein said power link is straight and includes an elongated opening for receiving said driving pin and said stationary pin.

7. The invention as set forth in claim 5, wherein said attachment link is straight and includes an elongated opening for receiving said driving pin and said pushrod.

8. An adjustable pedal apparatus comprising:

a stationary base formation having a first and second longitudinally extending slot formed therein;

a pedal having a pivot pin adapted to be received by said second slot, said pedal pivotable about said pivot pin;

a translational structure attached to said pedal such that said pedal can translate thereon;

a driving pin adapted to be received in said first slot;

a stationary pin;

a pushrod;

a power link pivotally attached to said pedal and adapted to interconnect said stationary pin and said driving pin with said pedal; and an attachment link pivotally attached to said pedal and adapted to interconnect said pushrod and said driving pin with said pedal.

9. An adjustable pedal apparatus comprising:

a base formation having a first and second longitudinally extending slot formed therein;

a pedal having a pivot pin adapted to be received by said second slot, said pedal capable of pivoting about said pivot pin;

a screw threadedly attached to said pedal such that said pedal can translate thereon in response to rotation of said screw;

a driving pin adapted to be received in said first slot;

a stationary pin disposed at an elevation comparable with the elevation of said pivot pin;

a pushrod adapted to activate the desired functions of the vehicle;

a power link pivotally attached to said pedal and including an elongated opening adapted to provide a sliding and pivotal attachment to said stationary pin and said driving pin;

an attachment link pivotally attached to said pedal at an elevation higher than said power link attachment to said pedal, said attachment link includes an elongated opening adapted to provide a sliding and pivotal attachment to said pushrod and said driving pin; and wherein said driving pin interconnects said attachment link and said power link.

* * * * *